US005584597A

United States Patent [19]

Lemelson

[11] Patent Number: 5,584,597

[45] Date of Patent: Dec. 17, 1996

[54] METHOD AND APPARATUS FOR ROAD HOLE REPAIR INCLUDING PREPARATION THEREOF

[76] Inventor: Jerome Lemelson, 868 Tyner Way, Incline Village, Nev. 89450

[21] Appl. No.: 403,652

[22] Filed: Mar. 14, 1995

[51] Int. Cl.[6] ..... E01C 23/09

[52] U.S. Cl. ..... 404/83; 404/90; 404/111; 404/107; 451/211; 299/41.1

[58] Field of Search ..... 299/41.1, 73; 451/211, 451/350, 352, 357; 404/90, 112, 83, 111, 107; 175/374

[56] References Cited

U.S. PATENT DOCUMENTS

| | | | |
|---|---|---|---|
| 3,209,472 | 10/1965 | Nickolaev et al. | 299/41.1 X |
| 3,539,014 | 11/1970 | Jonsson | 404/90 X |
| 4,173,836 | 11/1979 | Paurat | 37/81 |
| 4,458,949 | 7/1984 | Jury | 299/41.1 |
| 4,470,635 | 9/1984 | Paurat et al. | 299/1 |
| 4,968,101 | 11/1990 | Bossow | 299/41.1 |

*Primary Examiner*—James A. Lisehore
*Attorney, Agent, or Firm*—Louis Weinstein

[57] ABSTRACT

Apparatus for pretreating a pothole preparatory to filling thereof including determining the size and/or path of revolution of a treatment member responsive to determining the location and size of the pothole to be repaired; lowering the treatment member into the pothole; selectively revolving said treatment member and/or rotating said treatment member to abrade, compact and densify the portion of the pothole surrounding the surface thereof. Debris or other particulate in the pothole or developed by the abrading operation may be removed by a vacuum member. The pothole may be sprayed with a fluent material to either harden the surface or reduce the porosity of or render the sticky the surface of the pothole to provide a better bond between the pothole and the filler material. The force applied by the treatment member to the pothole surface is sensed and used as feedback information to control the abrading/compressing/densifying force.

29 Claims, 11 Drawing Sheets

METHOD AND APPARATUS FOR ROAD HOLE REPAIR INCLUDING PREPARATION THEREOF

FIELD OF THE INVENTION

The present invention relates to monitoring and filling apparatus and method and more particularly to apparatus and method for preparation of a pothole or the like preparatory to filling and repair.

BACKGROUND OF THE INVENTION

My U.S. Pat. Nos. 5,364,205 dated Nov. 15, 1994 and entitled "Method and Apparatus for Road Hole Repair" and 5,294,210 dated Mar. 15, 1994 and entitled "Automated Pothole Sensing and Filling Apparatus" respectively teach and disclose method and apparatus for locating, determining the size of, filling and repairing potholes and the like. The techniques described therein are characterized by utilizing computerized image analyzing and/or ultrasonic sensing techniques for detecting and determining the location and size of potholes and dispensing settable filling materials.

One of the significant problems encountered in pothole filling and repair is the premature breakdown or collapse of a repaired pothole or other road cavity which is due to the failure to treat such potholes preparatory to filling with the result that the internal surfaces and subsurfaces thereof which constitute the sidewalls and floor are quite porous and/or brittle causing a shell-like portion of the road encircling the filler material to break down, crumble or otherwise deteriorate with the result that the repaired pothole collapses prematurely requiring a subsequent repair at an earlier time than would otherwise be indicated.

Such corrective measures can be avoided by proper preparation and treatment of a pothole preparatory to filling.

It is also economically advantageous to prepare and treat potholes and the like in an automated fashion to thereby achieve the desired results in a more cost-efficient manner.

BRIEF DESCRIPTION OF THE INVENTION

The present invention achieves the above advantageous objectives through the use of method and apparatus which is characterized by an automated technique for the preparation and treatment of potholes, roadway cavities and the like which method comprises the steps of: sensing the location, shape and volume of a pothole in accordance with the technique and apparatus described, for example, in my aforementioned U.S. Pat. No. 5,294,210 to operate a manipulator supporting a pothole or cavity preparation tool under the control of code signals generated by an on-board computer, the cavity preparation tool being operated to abrade and/or shape and/or compress the cavity surface.

The tool is preferably annular-shaped and is capable of being selectively oscillated per se or, revolved and rotated to perform the pothole wall shaping/abrading/compressing functions whereby the surfaces of the cavity are compacted to receive and support the filler material.

Sensing means are provided to sense the force or pressure experienced by the tool due to engagement with the surface or walls of the cavity to further aid in control of the compacting, shaping and abrading operations.

Further preparatory steps may include injecting a fluent material (which may pass through suitable outlets in the treatment tool) upon the surface of the cavity, which fluent material penetrates the pores or interstitial structure beneath the surface of the cavity to eliminate or reduce the porosity of the surface stratum of at least a shell-like portion adjacent to the cavity surface to a predetermined depth thereof and/or to coat or harden the cavity surface and/or to function as a support binder or adhesive for a pothole filling material flowed into the pothole thereafter.

All of the above tools are preferably mounted upon a vehicle or vehicle pulled trailer which also supports the cavity detection and scanning sensors and cavity size and volume determining computer apparatus.

A still further embodiment of the present invention includes vacuum means which may be utilized to withdraw debris or particulate broken away from the cavity surface during the operations of shaping, abrading and compressing the material thereof.

OBJECTS OF THE INVENTION

It is, therefore a primary object of the present invention to provide novel automated apparatus for filling and repairing potholes and the like including means for treating a pothole preparatory to a filing operation.

Another object is to provide a novel method and apparatus for treating a pothole preparatory to filling and repair of same.

Still another object of the present invention is to provide a novel method and apparatus for treating potholes and the like preparatory to filling and repair thereof wherein the treating operation includes selectively performing one or more of the operations of abrading, shaping, compressing and densifying the surface and/or subsurface of the cavity.

Still another object of the present invention is to provide a novel method and apparatus for treating potholes and the like preparatory to filling and repair including coating the surface of the pothole cavity with a fluent material to selectively provide one of the functions of: reducing the porosity of, hardening the surface of and rendering adhesive a surface stratum of the cavity to be repaired.

Still another object of the present invention is to provide novel method and apparatus for treating cavities and the like preparatory to filling and repair thereof comprising the steps of: abrading and/or shaping and/or compressing and/or densifying and subsequently vacuuming the pothole cavity to remove unwanted particulate and other debris.

DETAILED DESCRIPTION OF THE INVENTION AND THE PREFERRED EMBODIMENTS THEREOF

Figure 2:
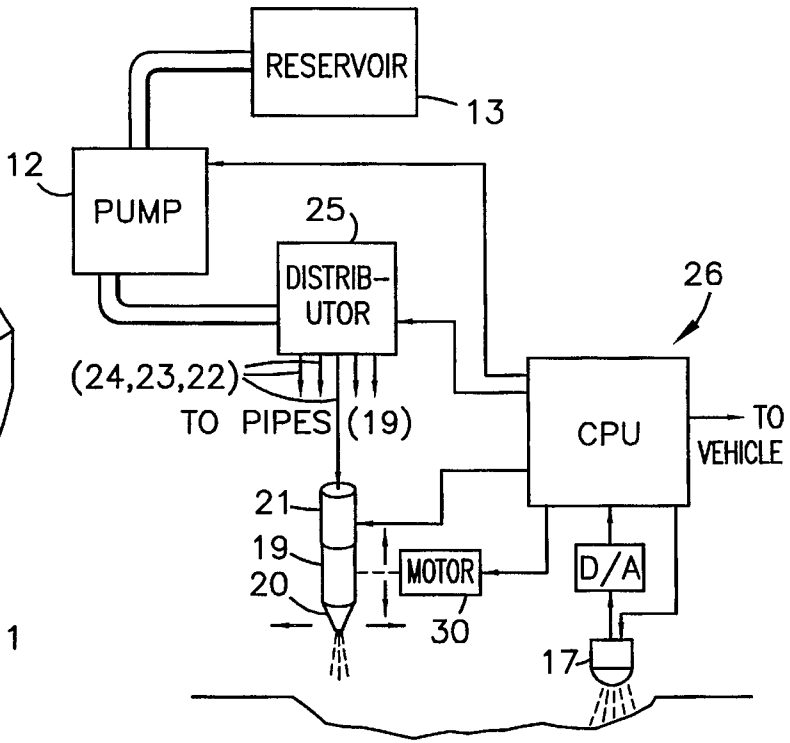
FIG. 2 shows a schematic diagram incorporating the control means for operating the system of FIG. 1.
Figure 1:
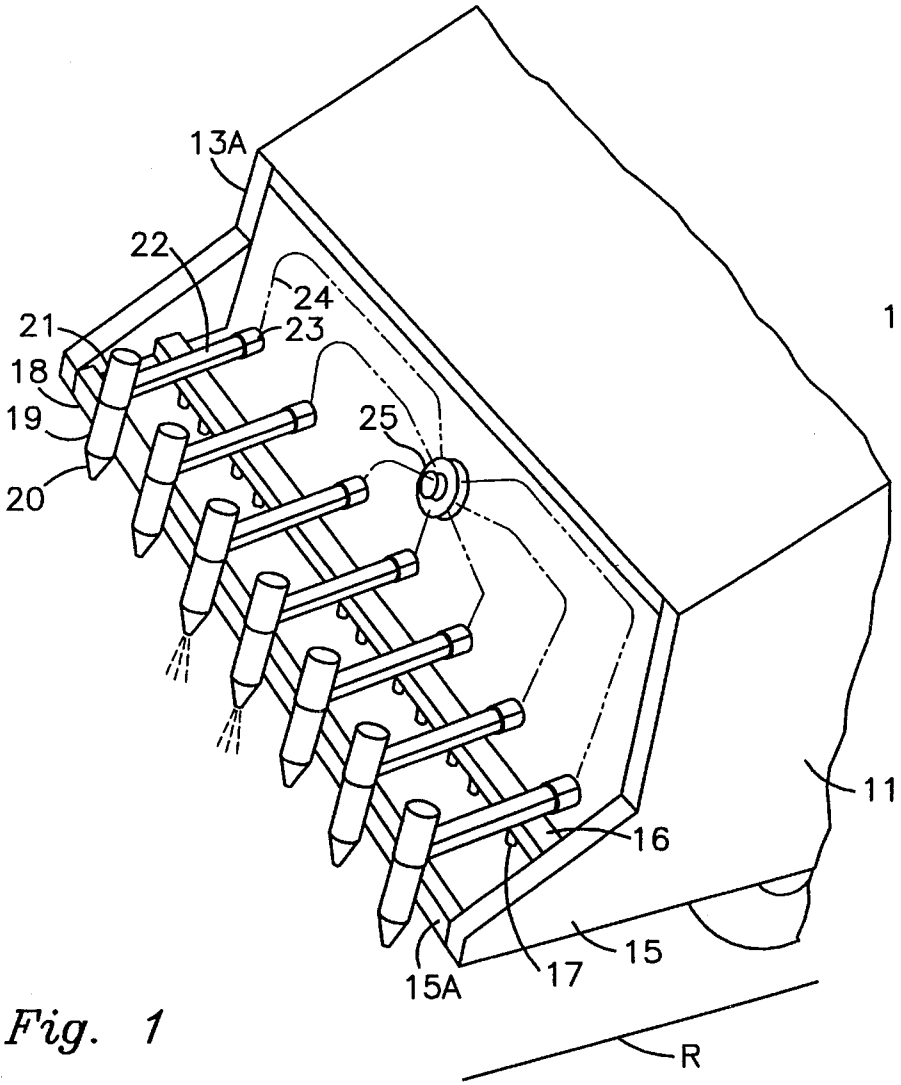
FIG. 1 is a perspective view showing a repair system for detecting the size and location of a pothole and filling same.

FIGS. 1 and 2 show a first embodiment 10 of the present invention comprising a wheeled mobile vehicle which may be of the self-propelled type including a truck portion (not shown for purposes of simplicity) or alternatively, capable of being coupled to and towed by a self-propelled vehicle for movement along a highway, road or other paved surface, said surface having one or more faults or cavities, such as potholes, to be filled with a filler or repair material, such as a liquid resin or mixture, such as macadam, asphalt, asphalt and crushed stone or one or more resins mixed therewith, etc. Filling may occur either while the vehicle is in motion or is halted or during periods when the vehicle is in motion and stopped.

The rear end 15 of vehicle 10 includes a frame or bar 15A extending across the rear of the vehicle and aligned lateral to the longitudinal direction thereof, and adapted to support an array of nozzles 20 preferably arranged at equi-spaced intervals (for example, six inches or less apart) one or more of the nozzles being operable to dispense a measured quantity of fluent hole or cavity filling material supplied under pressure or delivered by or under the influence of gravity from a reservoir or container 13 forming part of the vehicle body 11.

Nozzles 20 extend downwardly and their interiors communicate with a plurality of conduits 19, each of which is provided with a solenoid operated valve 21 for selectively delivering liquid filler to respective ones of the nozzles 20. Coupler fittings 23 connect each of the conduits 22 to an associated conduit 24, coupling each nozzle 20 to a distribution means 25 preferably arranged along the rear wall 13A of vehicle body 11.

The distributor 25 may have a single input, selectively feeding one or more outputs. For example, a feed screw may advance repair material along a trough or cylindrical conduit having a plurality of outlets at spaced intervals arranged laterally in the means shown in FIG. 5, each outlet being provided with a control valve (see also FIG. 9). Repair material may be advanced in an amount or at a rate sufficient to accommodate more than one open control valve, i.e. such that any one outlet dispenses repair material at a rate less than the flow rate through the conduit or trough to enable delivery of repair material to more than one open outlet at a time.

The distributor may alternatively comprise a plurality of openings at the bottom of the reservoir or container holding the repair material, each opening provided with a flow control valve. The repair material may be gravity fed. More than one of the control valves may selectively be opened at the same time depending on the extent of the cavity or pothole.

Figure 9:
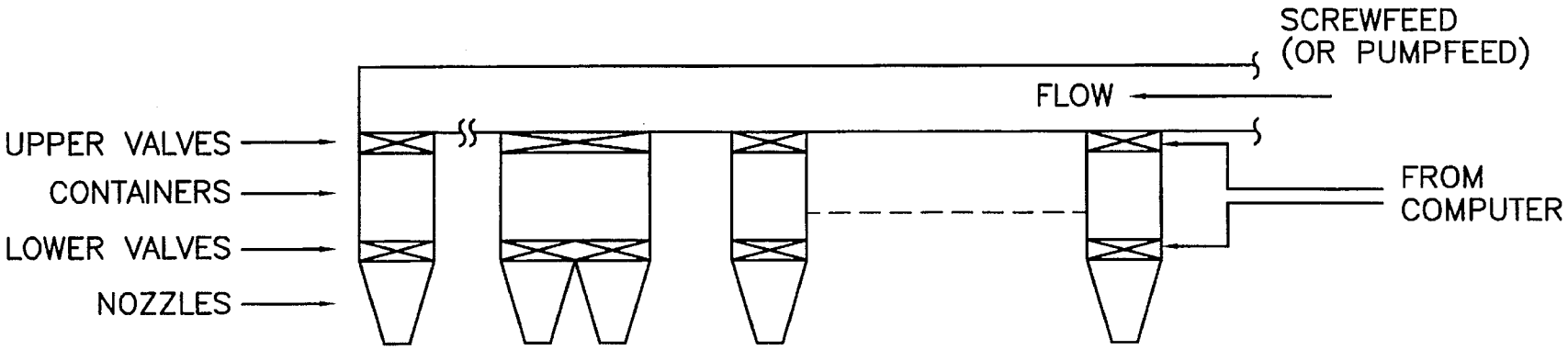
FIGS. 9 and 9*a* show simplified diagrams of an alternative filler material apparatus.

A container may be provided between each of the outlets and the nozzle (FIG. 9). An upper valve is selectively opened by the computer to fill (or partially fill) its associated container. The lower valves are selectively controlled by the computer to dispense repair material. The containers may be provided with two or more nozzles, each nozzle having an associated lower control valve. The container may be refilled if more repair material is needed to fill a large pothole. The containers contain a predetermined quantity of material in applications where a controlled amount is desirable. In applications where one nozzle is being fed, the upper and lower valves may remain open at least until the desired amount of material is dispensed.

The volume of containers C (FIG. 9*a*) may be adjusted by rotating lower container portion $C_L$ by rotating motor M to rotate spur gear $G_1$ engaging gear $G_2$ in one of two opposing directions to move container portion $C_1$ up or down relative to portion $C_2$. $C_1$+$C_2$ are threadedly engaged by threaded means along the inner periphery of $C_1$ and the outer periphery of $C_1$ and the outer periphery of $C_2$. An O-ring R maintains a liquid-tight sliding seal. Motor M is controlled by CPU 201, for example, (see FIG. 8). AS an alternative, the gears $G_1$, $G_2$ may be a rod and pinion arrangement, gear $G_1$ serving as the pinion gear and $G_2$ being replaced by an axially aligned rack engaged by $G_1$ to move $C_1$ (joined to the rack) up and down to adjust volume. Guides may be provided to prevent $C_1$ from rotating about its longitudinal axis.

The multiple dispenser arrangements of FIGS. 1 and 9 may be employed for a variety of applications, such as:

1. Automatic road paving per se where it may be required to variably distribute asphalt or other material on an unpaved or previously paved surface depending on lateral grading and the condition of the previous worn paving.
2. Sheet or panel laminating apparatus where adhesive and/or molten or liquid resin is controllably applied to a sheet or panel surface or surfaces (using resin, adhesive or other filler material delivered by injection-molding type screw feed (or other suitable means) to select lateral locations along the surface of the base or sheet.
3. The filling of multiple injection, slush or rotational molds or concrete molds held stationary or on a conveyor. The dispenser may be lateral to or aligned with the direction of movement of the conveyor.
4. Multiple bag, can or box filling lines. Production may be doubled, tripled, or quadrupled using a single computer controlled, multi-spout filling barrel or screw with computer control of solenoid valves for each spout.

A plurality of sensors 17, preferably arranged at equispaced intervals along an elongated support bar 16, scan respective lateral portions of the roadway surface for detecting potholes, depressions or other surface irregularities requiring repair or filling. Initial treatment of potholes or the like is beyond the scope of the present invention. However, it is appropriate to understand that such treatment may include high pressure blowers and/or coring or digging means, supported by the vehicle 11 or another vehicle, if necessary, to prepare a pothole for filling. Such preparatory activity may be totally independent of the repair activities described herein or may be integrated therewith.

Sensors 17 may comprise any suitable type of distance measuring means such as, for example, electro-optical devices (including photo-electric surface detectors, video cameras or laser scanners), ultrasonic pulse echo transducers or any other suitable devices capable of detecting the surface, contour or topography of roadway R. The scanners may be operated simultaneously or sequentially on a time-share basis and may be moved independently of one another. Sensor signals are processed by a central electronic processor or CPU 26 for computing the locations and shapes of cavities scanned and the amount of cavity filling material required to fill each cavity, providing control signals for controlling the operation of pump 12, distributor 25 and solenoid operated valves 21 to control the amount of filler resin dispensed.

The nozzles 20 and scanners 17 may be movable and driven by suitable motors such as, for example, motor 30 driving nozzle 20 shown in FIG. 2. The nozzles 20 may be movably mounted along support 15A, conduits 22 preferably being sufficiently flexible to enable lateral movement of the nozzles.

The scanners 17, upon detecting the presence of a pothole (see FIG. 2) provide signals analyzed by CPU 26 which are utilized to control the vehicle in the form of providing an alarm signal upon detection of a pothole for either slowing the speed of the vehicle or stopping the vehicle when a pothole is detected.

Figure 3A:
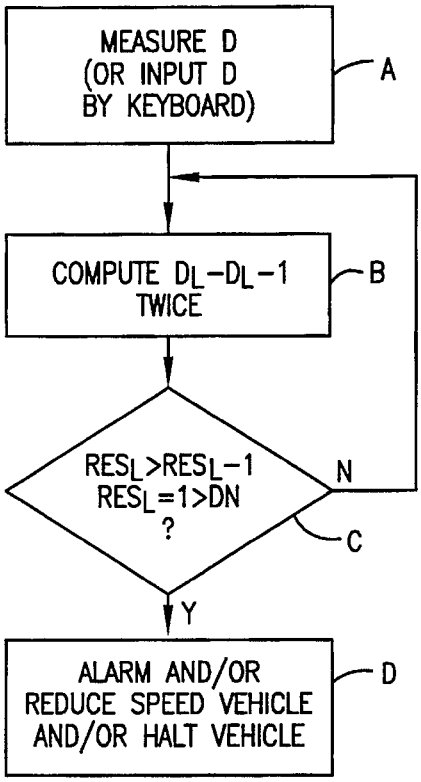
FIGS. 3*a* through 3*c* are flow diagrams useful in explaining the operation of the systems of FIGS. 1 and 2.

Noting, for example, the flow diagram of FIG. 3*a*, roadway distance from the scanner 17 is measured at step A at predetermined intervals, for example, of the order of 1,000th of a second. At a vehicle speed of 15 miles per hour, for example, measurements are taken every 0.264 inches. Each distance measurement is temporarily stored in a memory (see FIG. 8) and compared with the next distance measurement. The difference between the two measurements is stored in a memory. The steps are repeated preferably at least twice. When the last result is greater than the immediately previous result and when the immediately previous result is greater than the distance of the normal road surface which is established as the distance between the scanner and the road surface in the absence of a depression, the system provides an alarm to the vehicle operator and/or to the engine or motor controls to slow the vehicle and/or stop the vehicle. As an alternative, the distance between scanner 17 and the normal road surface may be manually inputted into memory by a keyboard input (note FIGS. 6 or 8). The inputted distance is then compared with the measured distance to control vehicle movement.

Figure 4:
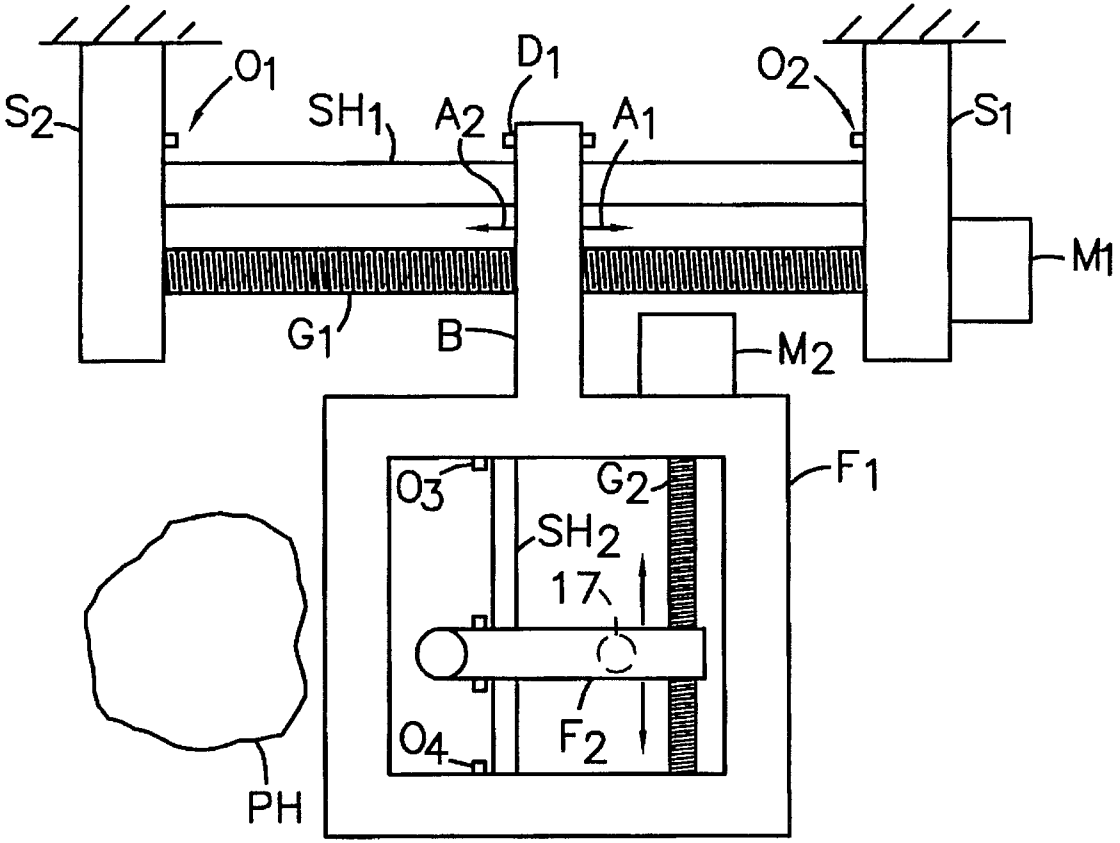
FIG. 4 is a plan view of a positioning system which may be employed in the embodiment of FIG. 1.

FIG. 4 shows an arrangement for moving a sensor 17 and/or a dispenser 20 which is comprised of a pair of supports S1, S2 supporting a fixed guide shaft SH and a worm gear G1 arranged within suitable bearings (not shown) to be freely rotatable about its longitudinal axis. A motor M1, mounted on support S1, selectively drives worm gear G1 in either a clockwise or counterclockwise direction to respectively move frame F1 either to the left or to the right as shown by arrows A1, A2, frame F1 having an integral bar B which is provided with an opening having a bushing for slidably receiving guide shaft SH and a threaded opening for threadedly engaging worm gear G1.

Frame F1 has a similar guide shaft SH2 and worm gear G2. A support frame F2 supports dispenser nozzle 20 and/or sensor 17, frame F2 being similarly provided with a bushing for slidably receiving guide shaft SH2 and a threaded opening cooperating with worm gear G2, which is driven by motor M2. Motors M1 and M2 may be driven either simultaneously or sequentially under the control of CPU 26 (see FIG. 2).

In one embodiment, the sensor 17 is positioned above a pothole as shown in FIG. 2*a*. Considering the flow diagram shown in FIG. 3*b*, sensor 17 measures the normal distance between the sensor and the road surface in the absence of any depression or pothole (or alternatively stores a manually inputted value). This distance value is stored in memory (step A1).

The sensor 17 and nozzle 20 are positioned over the pothole PH, resin or mixture is dispensed by operating pump 12 and the associated solenoid control valve 21 and distance measurements are taken at periodic intervals by sensor 17 (step B1).

The distance measurements may be taken, for example, at time intervals in the range of from 0.05 to 0.10 seconds (step B1). Each distance measurement is compared against the normal distance DN. When the difference between the distance measurement measured and the normal distance is equal to or less than a predetermined constant K, dispensing is halted (steps C, D and E). Comparison step C is continually repeated until the difference between the distance measurement and the normal distance meet the criteria of step D. The value of K greater than zero may be equal to the amount of filler material between the valve and the outlet of the nozzle when the valve is closed.

Figure 3B:
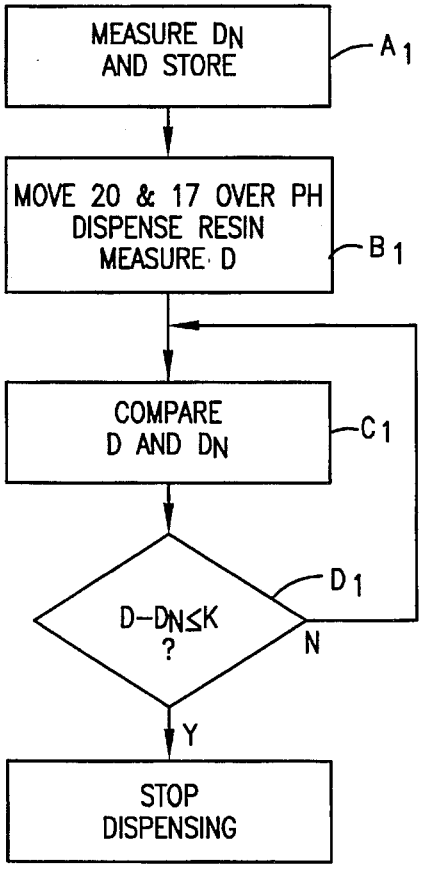
Figure 3C:
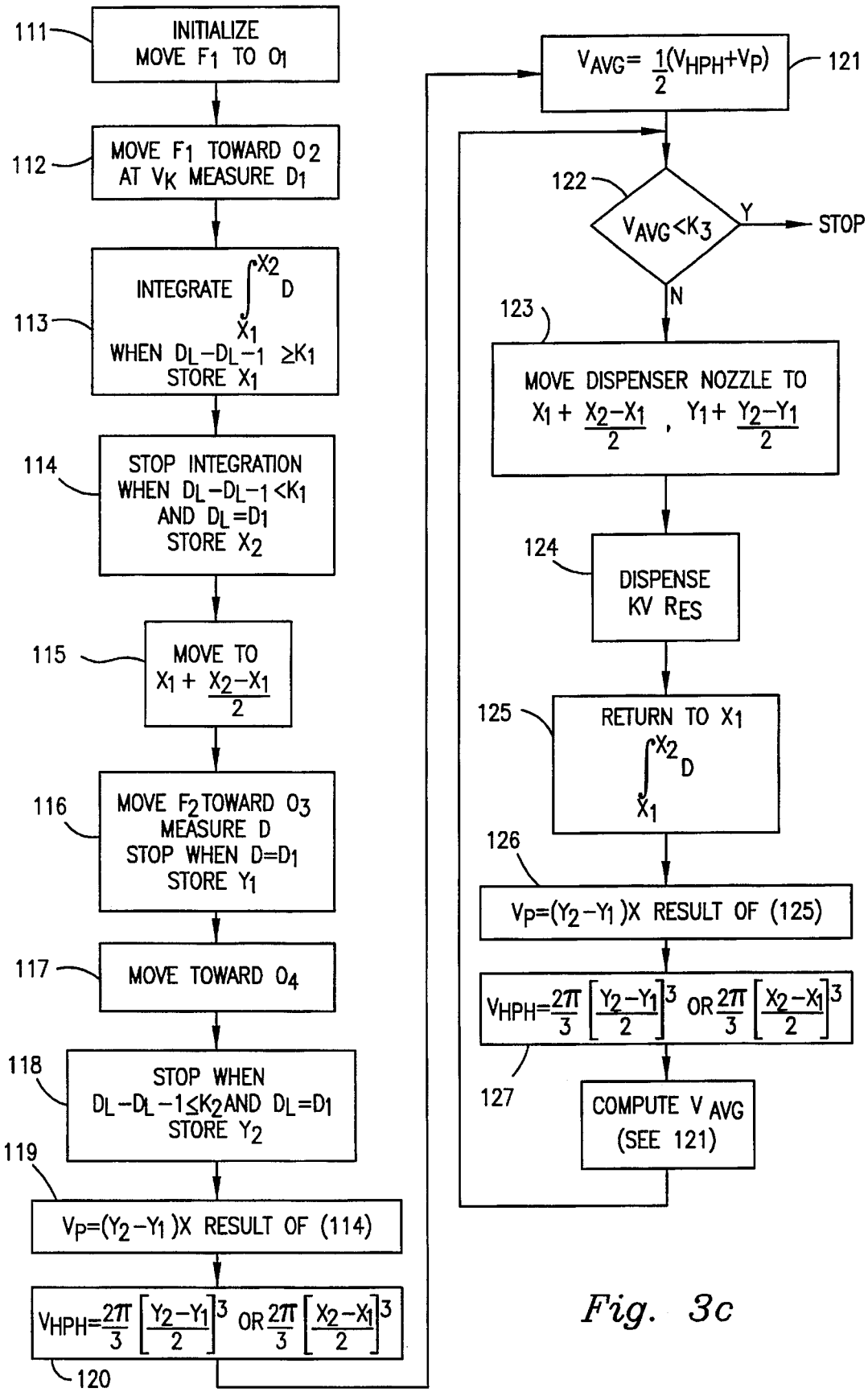

The flow diagram of FIG. 3*c* shows another technique for filling potholes and employing, for example, the positioning means shown in FIG. 4.

In step 111, the system is initialized and frame F1 is moved to point O1, a sensor or detector D1 mounted on bar B of frame F1 detects this position. At step 112, frame F1 is moved toward position O2 at a constant rate. Sensor 17 measures the distance between the sensor and the road surface. Alternatively, this value may be permanently stored since it is dependent upon the position of the sensor 17, or the value may be manually inputted by a keyboard. These values are integrated when the difference between the last value DL and DL−1 is equal to or greater than a constant K1, the position X1 is noted and stored and integration continues in this manner.

At step 114, integration is halted when the difference between the last distance measured and the next to the last distance is less than K1 and the last distance measured is equal to the normal distance D1. In addition, the position X2 is stored.

At step 115, the halfway point between X1 and X2 is calculated and the sensor is moved to this half way point. At step 116, frame F2 is moved toward O3 during which the distance D is measured. When D is equal to D1, the value Y1 is stored. At step 117, the sensor is moved toward O4 and at step 118, scanning is stopped when the last distance measured minus the next to the last distance measured is less than K2 and when the distance measured is equal to the normal distance D1. The value Y2 is then stored.

At step 119, an estimate of the volume is made by multiplying the value Y2−Y1 with the result of the integration performed at step 114. At step 120 it is further assumed that the volume is a half of a sphere and the calculation for half of a sphere is performed employing either $(X_2-X)/2$ or $(Y_2 31\ Y_1)2$ or any average of these two values as the radius of the half-sphere. An average of the two volumes determined at steps 119 and 120 is obtained at step 121. If this average volume is less than a constant K3 (step 122), the program is halted and returned to step 111. Assuming that the average volume is greater than K3, at step 123, the dispenser is moved to the appropriate coordinate position and resin is dispensed at step 124. The amount of resin needed is a function of the volume plus a constant.

Dispensing is terminated, integration employing the coordinates X1 and X2 is performed at step 125 and the estimated volumes at step 126 and 127 are performed which are substantially the same as steps 119 and 120. The average of these volumes is determined at step 128 and this average is compared against the constant K3. These steps are repeated until the average volume is less than constant K3 which is equal to or close to zero.

If desired, steps 120, 121, 127 and 128 may be omitted and the volume calculated at step 119 may be utilized as the volume which is compared against constant K3.

Figure 5:
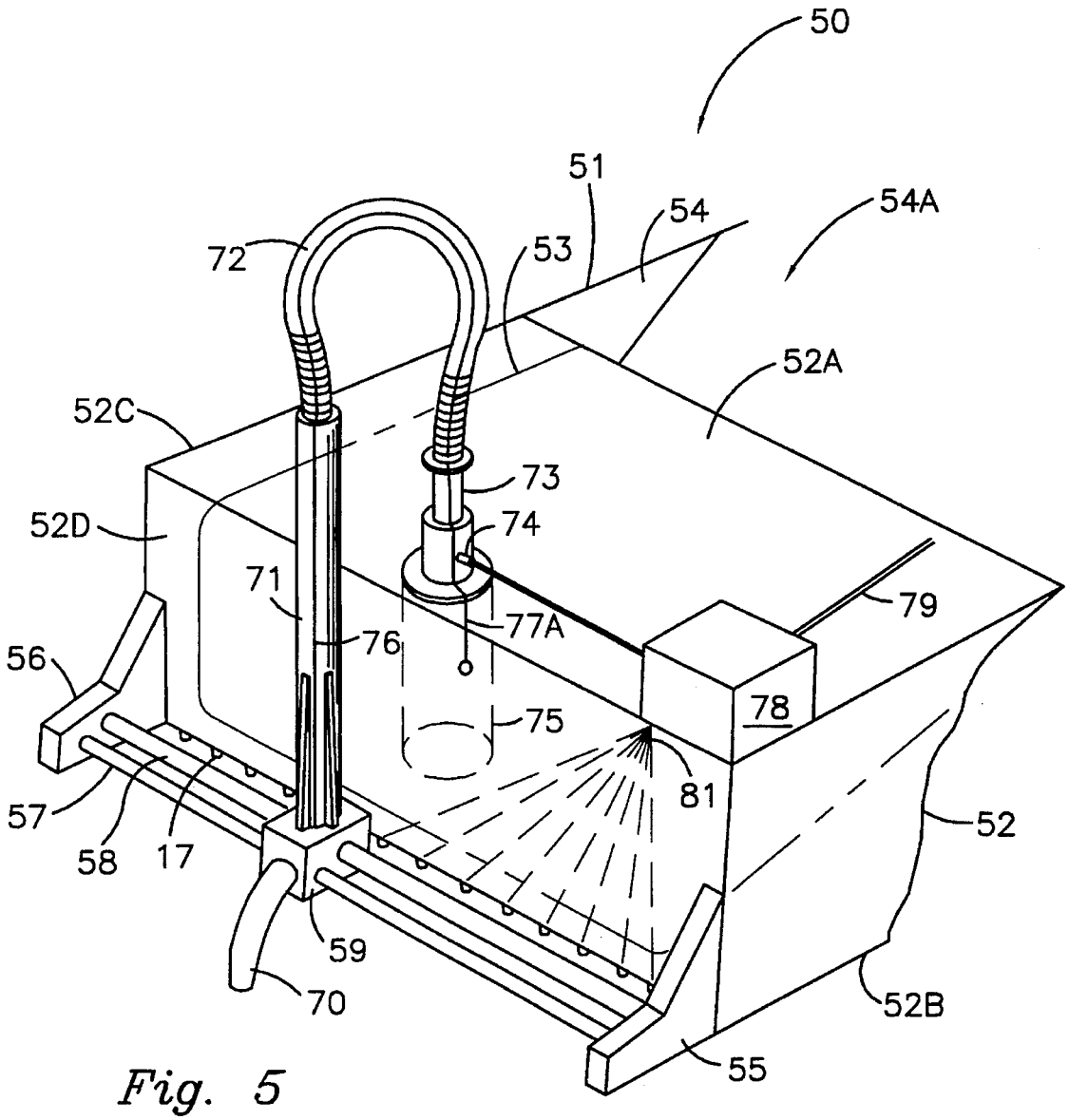
FIG. 5 is a perspective view showing still another embodiment of the present invention.
Figure 5A:
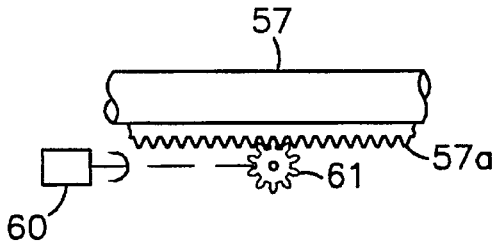
FIG. 5*a* shows a detailed view of the nozzle drive portion for the nozzle assembly employed in the embodiment of FIG. 5.
Figure 6:
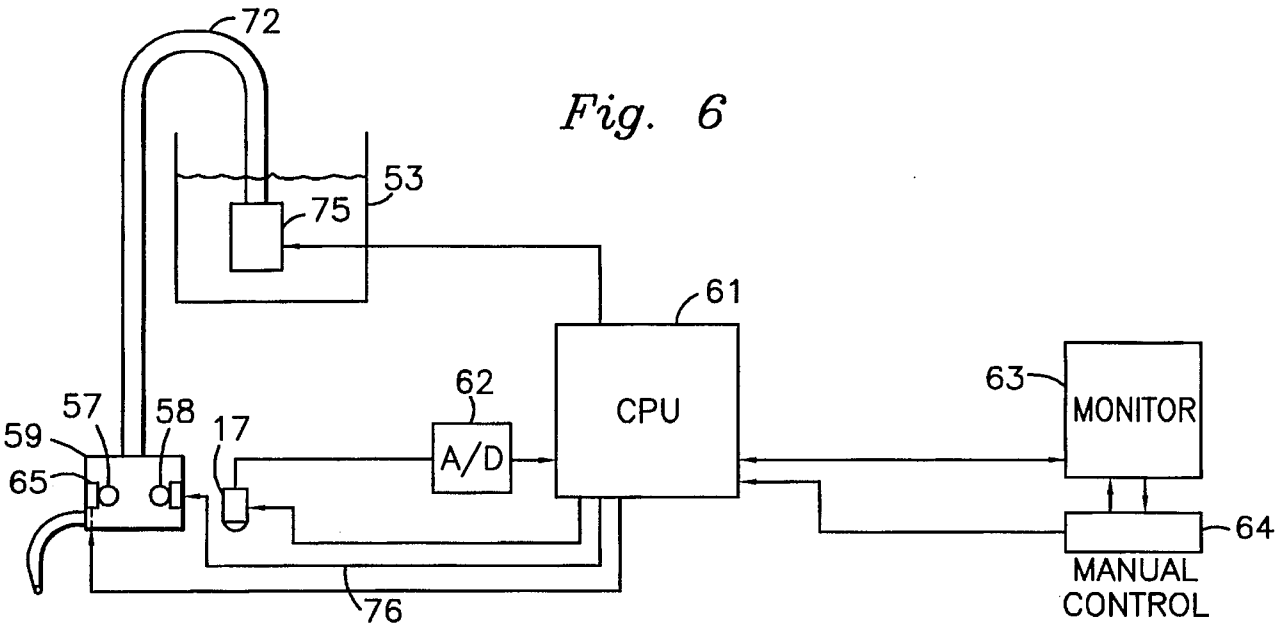
FIG. 6 shows a simplified block diagram of the control system for controlling the embodiment of FIG. 5.

FIGS. 5, 5*a* and 6 show still another embodiment 50 of the present invention which, like the embodiment 10, the apparatus may be either self-propelled, towed or pushed by a wheeled, self-propelled vehicle 51 having a body 52 with vertical side walls 52*b*, 52*c* and rear end wall 52*d* mounted upon a frame (not shown) and supporting a tank or reservoir 53 for the storage of fluent or liquid filler material of any of the types described hereinabove. Opening 54 at the top of the vehicle body communicates with hopper 54A for filling the tank. A pair of brackets 55 and 56 are welded or otherwise secured to body 52 and support a pair of spaced parallel rods 57, 58 defining a trackway along which a carriage 59 is drivable by a reversible gear motor 60 having a drive gear 61 engaging the teeth of a rack 57*a* provided along the underside of shaft 57, as shown in simplified fashion in FIG. 5*a*. In a modified form, the rack and pinion drive arrangement of FIG. 5*a* may be substituted for the worm gear drive of FIG. 4, or vice versa.

Carriage 59 supports a downwardly extending dispensing nozzle 70 for delivering resin to fill cracks, potholes or the like in the road surface. The nozzle is driven into alignment with the recess or cavity to be filled either while the vehicle is stopped or is in motion.

As in the embodiment 10, a plurality of sensors 17 sense a cavity or cavities in the roadway and generate sensing signals fed to a CPU 61 by way of an A to D converter 62. CPU 61 may be arranged within housing 78 or may be remote therefrom, such as, for example, adjacent to or within the cabin of the self-propelled vehicle. Sensors 17 provide signal information for determining the location and calculating the volume of the cavity and generate coded signals which define the shapes and locations of such cavity or cavities. The data may be utilized to provide a topological-type plot which may be presented on display monitor 63. Sensors advantageous for use in mapping topology include ultrasonic pulse-echo scanners, video cameras, employed alone or together with distance sensors to detect volume, if desired.

A pump 75 provided either within or communicating with the storage tank 53 is coupled to and driven by CPU 61 through leads 77. An elongated section of corrugated flexible tubing 72 has a first end coupled to pump 75 through a fitting 73 secured to the top wall 52*a* of vehicle body 52.

The opposite end of flexible tubing 72 is coupled to the upper end of a somewhat rigid tube 71 which communicates with nozzle 70 through a conduit provided within housing 59 to dispense resin into cavities, cracks, potholes and the like aligned beneath nozzle 70. Tubing 72 is sufficiently flexible to permit carriage 59 to travel along the guide shafts 57 and 58 and between the extreme ends thereof, under control of control signals from CPU 61. Coupling 74 selectively couples the leads 77 to the electrical terminals of pump 75. The dispenser nozzle need not pass through housing 59 and alternatively may be secured to one side wall to reduce the number of curved paths traversed by the filler material.

A cable 76 containing one or more wire pairs extends from housing 59 upwardly along tube 71 to be coupled with connector 74 for the control of motor 60 by CPU 61 (this connection is shown in simplified fashion in FIG. 6). A cable 81, comprised of a plurality of wire pairs, extends from CPU 61 to the array of sensors 17.

As an alternative, two or more carriages, similar to carriage 59, may be provided to travel along a pair of guide shafts to permit the simultaneous filling of a single cavity by two nozzles or a pair of adjacent cavities or potholes. If desired, two or more nozzles may be mounted on and driven by housing 59. The signals generated by CPU 61 responsive to the scanning signals generated by sensor 17 control the motors driving each carriage to align each nozzle 70 with one or more cavities or potholes in the road surface and control pump 75 and a separate valve 65 to control the amount of filler resin introduced into the cavity.

The control techniques may be similar to those shown in FIGS. 3*a*–3*c* to obtain either volume information, as shown in the embodiment of FIG. 3*c*, or to determine when the cavity is filled in the simplified version shown in FIG. 3*b*. Alternatively, the sensors may be employed to provide a control alarm signal and/or to control the speed or stopping of the vehicle responsive to information from sensor 17 preparatory to filling a cavity, in the manner shown by the flow diagram of FIG. 3*a*. As an alternative to driving the worm gears G1 and G2, the sensors 17 within the array are selectively energized, their spacing distances being predetermined.

CPU 61, as set forth hereinabove, is coupled to monitor 63 which may preferably be arranged within the cabin of the self-propelled vehicle. Manual control means are provided to manually input information to make requests or to override operations controls by CPU 61, for example, in accordance with the software program shown in FIGS. 3*a* through 3*c*. In addition to the embodiments shown in FIGS. 1, 3 and 4, the scanner 17 may be one or an array of TV cameras scanning to sense the contours of the cavities, as well as laser, ultrasonic (pulse echo) scanners for scanning depth to determine volume.

The sensors may be fixed in the arrangement as shown in FIG. 5 or movable as shown, for example, in FIGS. 1 and 4. The sensors may scan different strip-like widths of the road to detect locations in volumes.

As a further alternative, the top surface of the filler resin may be sensed or detected to determine when a pothole is filled by means of suitable photo-electric and/or ultrasonic pulse-echo scanning and detection means.

One or a plurality of delivery nozzles may be provided and arranged in either a stationary or movable fashion. When employing a plurality of nozzles, two or more delivery nozzles may be utilized to fill a single pothole, if desired.

Figure 7B:
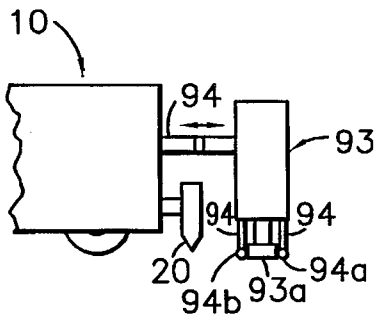
FIGS. 7*a* and 7*b* are elevational views of tamping means which may be employed with the embodiment of FIG. 1.
Figure 7A:
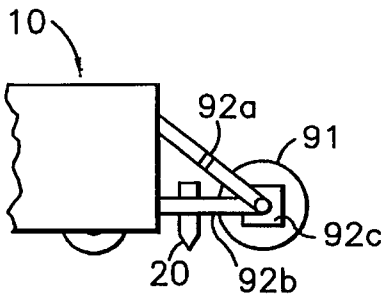

FIGS. 7*a* and 7*b* show further additions to the pothole filling assembly wherein the embodiment 10 of FIG. 1, for example, may be fitted with suitable tamping means such as, for example, a heavy roller 91 coupled to vehicle 11 by suitable supports 92*a*, 92*b* which may, for example, be driven by control signals from the CPU 26 (FIG. 2) for reversing the direction of the roller drive to reverse roller movement a number of times in order to compact the resin. Alternatively, the vehicle driving system 10 may be controlled to move the vehicle backward and forward to accomplish the tamping. Roller 91 may preferably be water filled to reduce the weight of the apparatus when being shipped between jobs. Roller 91 preferably extends the width of the system 10. As an alternative, roller 91 may be less than the width of system 10 and means 92C may be provided to move the roller laterally to roll over and hence tamp the filled cavity or pothole.

As a further alternative, FIG. 7*b* shows an arrangement in which tamping means 93 is mechanically coupled to the rear end of system 10 and may be reciprocated forwardly and rearwardly, as well as being movable laterally to place and operate a reciprocating tamping member over a filled cavity. Tamping member 93 may be suitably connected to system 10 by means 94 for holding the main tamping housing 93 a spaced distance above the road surface by way of structure 94.

Alternatively, a support frame comprised of four support members 94 (only two of which are shown in FIG. 7*b*) may each have roller members 94A for positioning tamping means 93 upon the road surface. Tamping means 93 is preferably provided with suitable pneumatic means for reciprocating a heavy tamper plate 93A to tamp asphalt or resin filling a cavity or the like under control of CPU 26, for example, as shown in FIG. 2. Tamping may be performed during and after filling, if desired.

In addition to filler and compacting means, means may be provided for curing the repair material. For example, the repair material may contain or comprise a radiation curable material, such as, a monomer or resin, and the road repair system 10 may be provided with a radiation source supported by vehicle 11 for irradiating such radiation curable material deposited within a repair cavity. The radiation source may be arranged either adjacent to or behind the filling nozzles. Noting, for example, FIG. 7*b*, the tamping means 93 may alternatively be a radiation source or may include such a source.

As another alternative, the repair material may comprise two or more constituents, each independently stored in separate tanks. The distributor means 25 may, for example, either sequentially or simultaneously dispense the constituents from each of said tanks into a common conduit which ultimately passes out of the nozzle 20 associated therewith. One of said constituents may be selected to chemically react with another one or ones of said constituents to effect curing or setting of the mixture in the pothole. Alternatively, or in addition to the chemical reaction, the tank 53, conduit 71 or housing 59, or both, may be provided with suitable heating means to either maintain the repair material in a molten state or convert the repair material to a molten state preparatory to delivery of the repair material into a pothole or other surface irregularity.

As another alternative, the tamping means 93 of FIG. 7*b* may be replaced by or have added thereto chilling means for rapidly chilling the repair material after it is dispensed. Alternatively, the repair material may be chilled just as it leaves the dispensing nozzle 20 by chilling means, such as, a blast of air surrounding the exit end of nozzle 20. An air blast and/or shock waves generated therein may be employed to tamp the material in the pothole.

Figure 8:
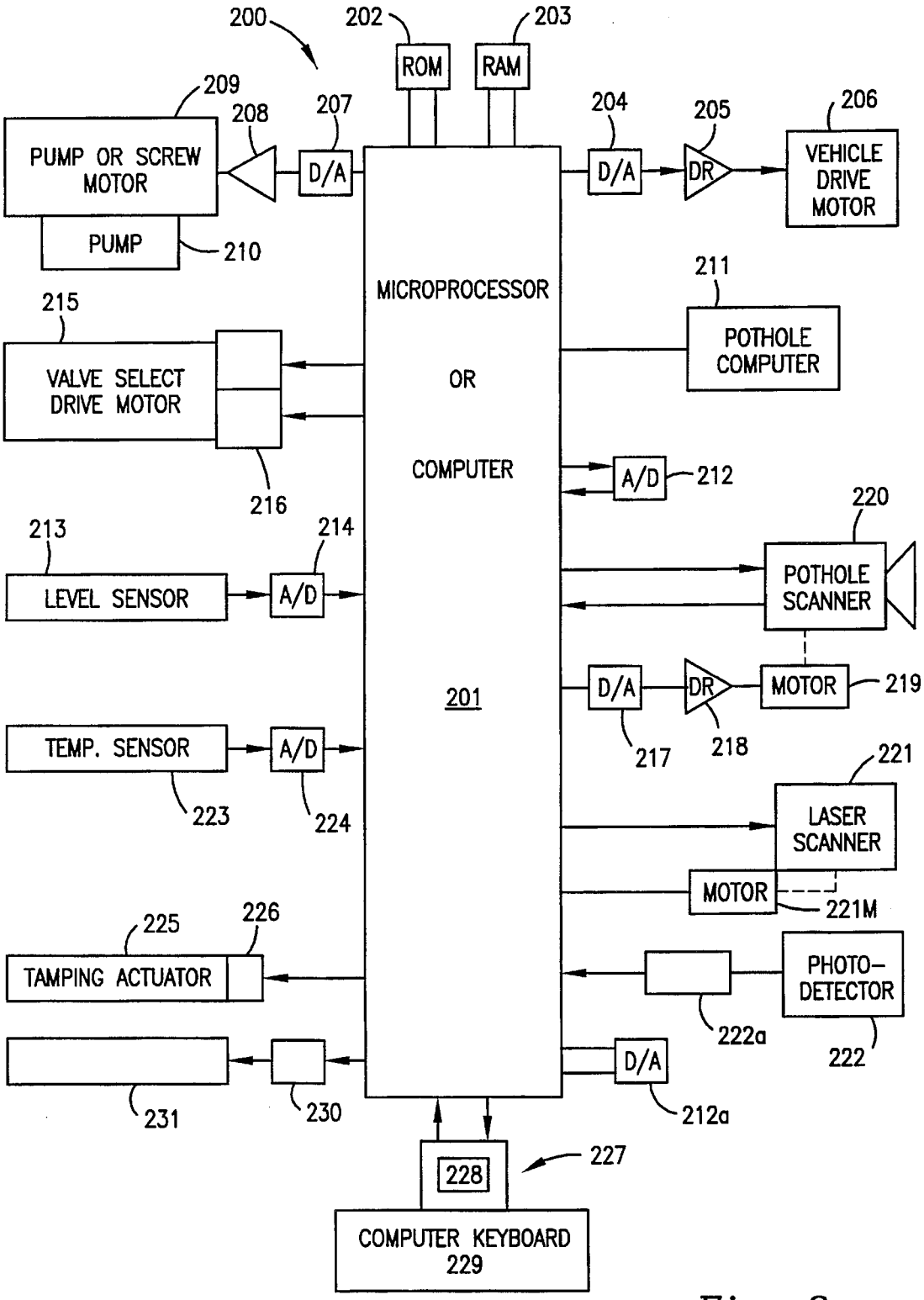
FIG. 8 shows a simplified block diagram of a general purpose control system which may be utilized to control the pothole repair system of FIG. 1, for example, as well as the pothole treatment means of FIGS. 10*a*–10*c*.
Figure 9A:
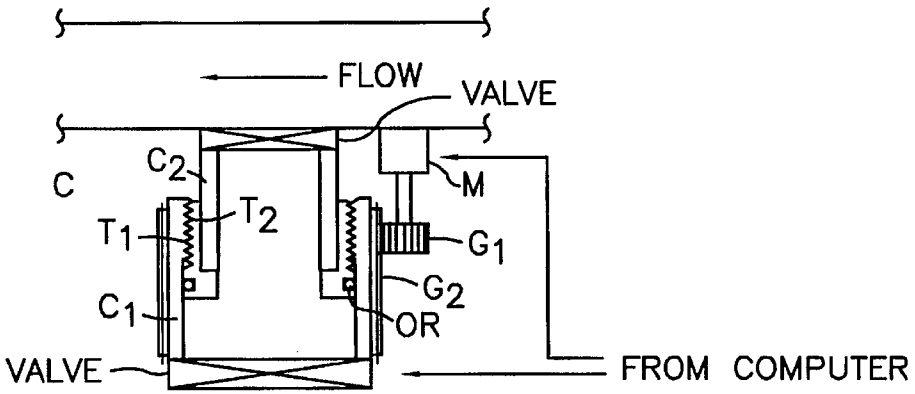

FIG. 8 shows a general purpose control system 200 for controlling the pothole filling apparatus 10 of FIG. 1, for example, to control the operation in any one of the modes described hereinabove, for example.

A microprocessor or computer 201 controls all of the peripheral devices, analyzes the scanning signals generated by sensor 17, for example, and provides control signals for controlling the operations of one or more motors, pumps, valves, and the like to control the flow and quantity of fluent resin or other filling material through one or more nozzles provided within the system, including positioning of such nozzles preparatory to dispensing asphalt, resin or the like.

Microprocessor or MPU 201 operates in conjunction with a number of memory devices including a random access memory (RAM) 203 temporarily storing and operating upon digital data such as current information relating to the operation of the apparatus or system 200. Read-only memory (ROM) 202 is utilized to store program information for controlling the operation and sequence of operations of system 200 including, for example, but not limited to, sensing cavities, detecting cavity volume, and filler level, controlling the positioning of sensors and dispensing nozzles as well as the heating and flow of filler material and tamping, compacting and curing the filler material provided within a cavity or pothole. Data recording and reproducing functions are performed when the memories are properly addressed and/or controlled by signals produced by MPU 201.

To optimize a cavity filling operation, provision is made in system 200 for variably controlling the speeds of motors driving the dispensing or driving vehicle and the other devices described above in accordance with the number of cavities per unit area of roadway to be filled as well as the volumes of such cavities and hence the amount of filling material required. For example, if the filling operation experiences a substantial increase in required flow of material due to an increase in the depth or the number of potholes directly beneath the vehicle, or, if movement of a dispenser nozzle 20 is necessary, or, if the maximum filling rate of a nozzle is insufficient to rapidly fill a cavity, the system may provide an output signal which, by way of digital-to-analog converter 204, is converted to an analog signal for regulating the vehicle drive motor 206, by way of a driver circuit 205 to slow or stop the vehicle in order to assure proper filling. If the vehicle utilizes an internal combustion engine or the like, motor 206 may be operable to variably control the combustion engine throttle, gas flow or the like, or alternatively, may be coupled with the vehicle braking system, as well as the throttle, to bring the vehicle to a halt.

In one operating mode, the location of a cavity is detected and its volume computed based upon signals outputted by a surface scanning system which may, for example, be an ultrasonic pulse-echo detection system employing common transducing means or a pair of send/receive transducers for respectively generating pulses of sound energy and receiving reflections thereof which are converted to pulsed or variable amplitude analog electric signals. These signals developed by pothole scanner 220 are analyzed by MPU 201 which develops control signals applied, for example, through digital-to-analog converter 207 and drive circuitry 208 to operate pump 210, for example, through pump or screw motor 209.

Pump 210 may be supplemented or replaced with a feed screw operating in a trough or feed cylinder terminating at the dispenser nozzle 20 (FIG. 1), for example, or a conduit connected therewith.

One or a plurality of the bank of nozzles mounted upon the vehicle may be selectively fed filler material by the distribution means 25 shown in FIG. 1 under the control of signals generated by computer 201, which further generates signals selectively applied to one or more of the solenoid control valves through control circuitry 216 and valve selector 215. For example, each nozzle may be coupled to a separate source of different filler material. The filler materials may be dispensed sequentially to provide layers of different filler material in the repaired hole. Alternatively, containers each storing a different repair material, may be sequentially coupled to one nozzle to obtain the above-mentioned layered result.

The positioning of pothole scanner 220 is controlled by computer 201 which provides control signals through digital-to-analog converter 217, drive circuitry 218 and motor 219. It should be understood that parallel digital-to-analog converter drive circuitry and motor means may be provided for controlling the driving of the scanner in mutually perpendicular directions in the manner shown, for example, in FIG. 4.

The system may be provided with a plurality of scanners either in addition to or to replace the pothole scanner 220 such as, for example, laser scanner 221 positioned by motor means 221M, photo detector 222 coupled to computer 201 through analog-to-digital converter 222*a*. Digital-to-analog and analog-to-digital converters 212 and 212*a* may be used to convert appropriate digital and analog signals from a plurality of peripheral devices on a time-share. The laser scanner may alternatively be a TV camera. Information from the TV camera is utilized to selectively operate the control valve(s) of the appropriate dispensing nozzle(s) as well as the termination of flow of repair material.

A tamping actuator 225 is controlled by computer 201 through control circuitry 226.

Temperature and level sensors 223 and 213 may be provided to detect the level of resin in the reservoir and its temperature, at least at the dispensing point, to assure proper operation.

Valve control 230 drive circuit is employed to control valve 231 to control the heat applied to the resin container or to a heating unit in or near nozzle 20, for example.

Manual control of the computer is obtained through keyboard 229. Data and/or video display is presented on the display screen 228 of monitor 227.

Figure 10A:
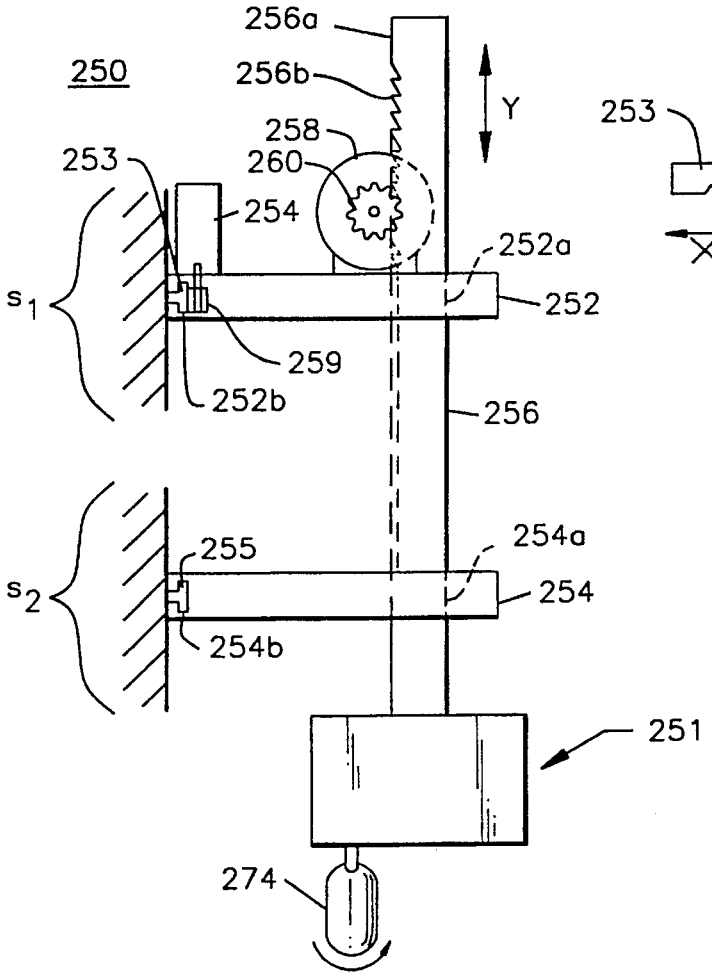
FIG. 10*a* is an elevational view showing apparatus for tamping, shaping and compressing a pothole.
Figure 10B:
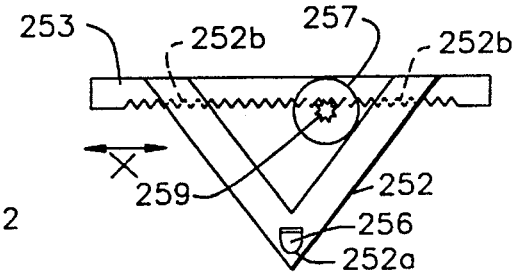
FIG. 10*b* shows a top plan view of a portion of the support assembly employed in the apparatus of FIG. 10*a*.
Figure 10D:
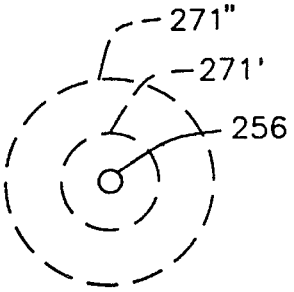
FIG. 10*d* is a simplified plan view showing the manner in which the distance between the revolvable shaft and main shaft is adjusted.
Figure 10E:
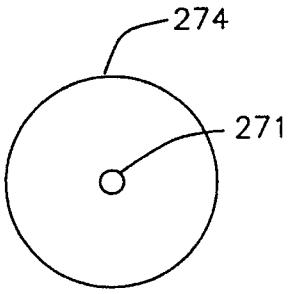
FIGS. 10*e* through 10*g* are top plan views showing different surface configurations of the treatment member of FIGS. 10*a* and 10*c*.
Figure 10F:
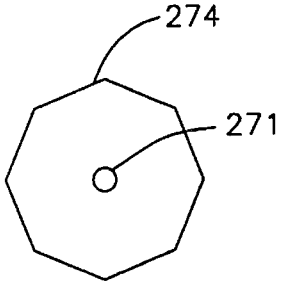
Figure 10G:
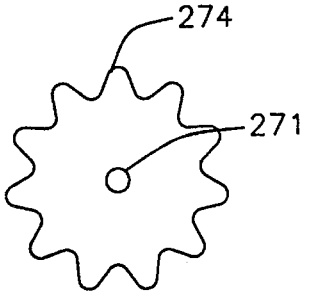
Figure 10C:
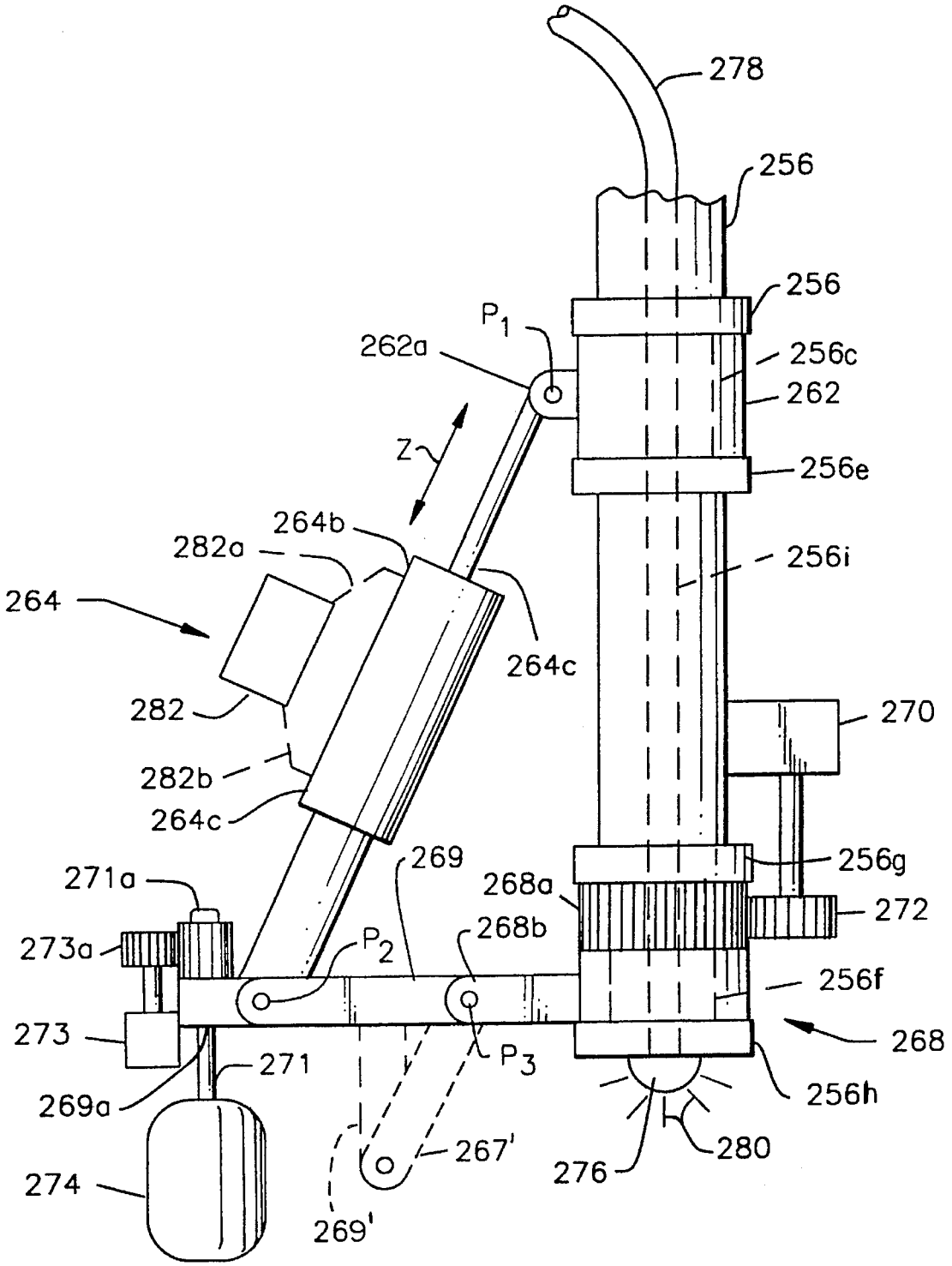
FIG. 10*c* is an detailed elevational view showing the rotatably/revolvable shaping/compressing assembly employed in the apparatus of FIG. 10*a*.

FIGS. 10*a* through 10*c* show an apparatus 250 employed for automatically pretreating a pothole or other like road cavity. Apparatus 250 is mounted on and supported by a wheeled vehicle such as a self-propelled vehicle, trailer or the like by suitable substantially V-shaped bracket assemblies 252 and 254 mounted to slide along tracks 253, 255 secured to supporting surfaces of the vehicle, shown schematically as surface members S1 and S2. Additional bracketing may be employed to provide additional support for apparatus 250, if desired.

Each of the support brackets 252 and 254 are provided with non-circular openings 252*a*, 254*a* provided at the apex of each V-shaped supporting bracket. The openings conform to the shape of an elongated shaft 256 which is generally circular in shape and has a flat surface 256*a* carrying a gear rack 256*b*. The openings 252*a* and 254*a* conform to the cross-sectional shape of shaft 256.

A gear-motor 258 is mounted on the upper bracket 252 and power rotates a gear 260 which engages a rack gear 256*b* to selectively drive shaft 256 either upwardly or downwardly as shown by the double-headed arrow Y.

Figure 10H:
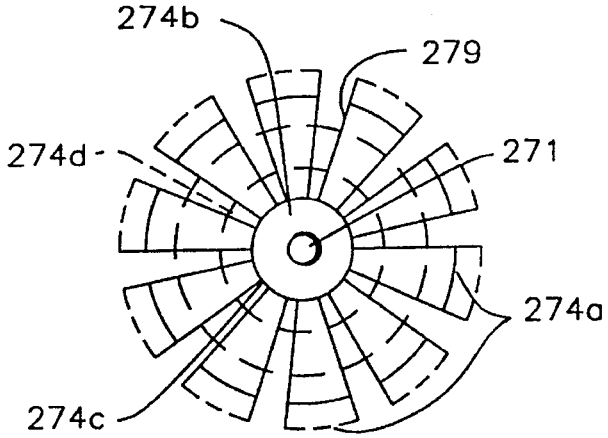
FIG. 10*h* is a top plan view and FIG. 10*i* is a perspective view of another alternative embodiment of the treatment member of FIGS. 10*a* and 10*c*.
Figure 10I:
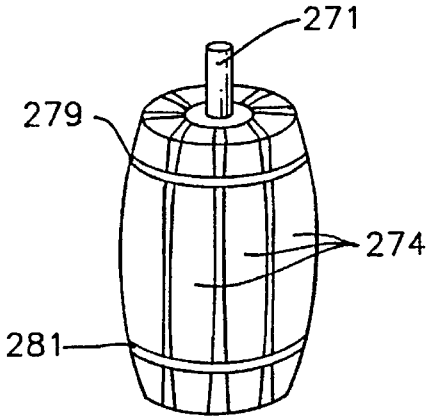
Figure 10J:
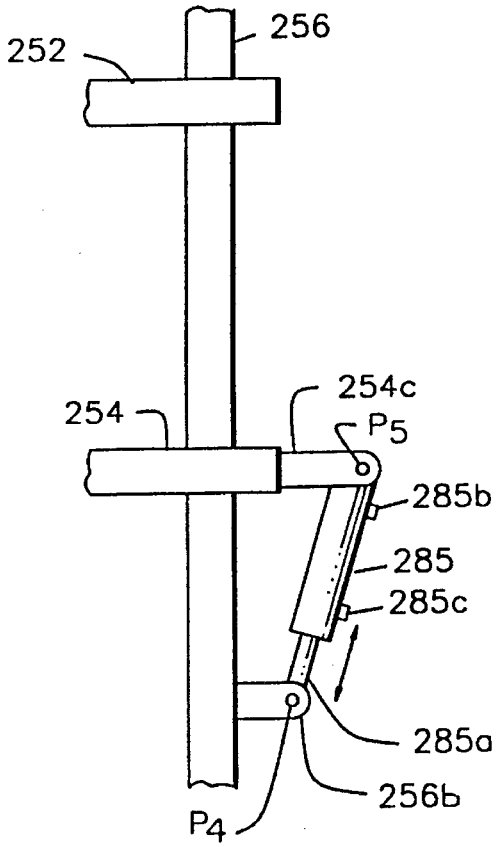
FIG. 10*j* is an elevational view showing another arrangement for lifting and lowering the shaft of FIG. 10*a*.

As an alternative arrangement, shown in FIG. 10*j*, rack 256*b* is eliminated, and motor 258 is replaced by an air or hydraulic cylinder 285 for operating shaft 256 up and down in the vertical direction as shown by double-headed arrow Y which action is effected by extending or retracting the piston rod 285*a* at the cylinder 285. Piston rod 285*a* is coupled to an integral projection 256*b* of shaft 256 by a pin P4 and cylinder 285 is coupled to an integral projection 254*c* of support 254 by a pin P5.

Shaft 256 supports at its lower end an assembly 251, shown in simplified block diagram form in FIG. 10*a*, which is operable for selectively revolving and/or rotating a road material treatment tool head 274. The detailed arrangement of assembly 251 is shown in FIG. 10*c*.

The lower end of shaft 256 is provided with two pairs of flanges 256*d*–256*e* and 256*g*14 256*h* secured thereto. The portion 256*c* of shaft 256 between flanges 256*d* and 256*e* has a circular cross-section. Similarly, the portion 256*f* between flanges 256*g* and 256*h* has a circular cross-section.

A hollow, cylindrical-shaped collar 262 is mounted to revolve about shaft portion 256*c* and is prevented from moving either upwardly or downwardly by flanges 256*d* and 256*e*. A similar hollow, cylindrical-shaped collar 268 is mounted to revolve about portion 256*f* of shaft 256 and is prevented from moving either upwardly or downwardly by flanges 256*g* and 256*h*. To the upper portion of collar 268 is secured a gear 268*a*. A gear-motor 270 is secured to shaft 256 just above flange 256*g*. The output shaft of motor 270 drives a gear 272 which meshes with gear 268*a* to rotate collar 268 for a purpose to be more fully described.

Collar 262 has an integral projection 262*a*. Collar 268 has a similar integral projection 268*b*. A linkage arm 269 has its right-hand end pivotally connected to an arm 268*b*, projecting from collar 268, by a pin P3. The left-hand end of linkage arm 269 is pivotally coupled to the lower end of a linear actuator or power cylinder assembly 264 by pivot pin P2.

Power cylinder 264 is provided with an actuator arm 264*a* the upper end of which is pivotally coupled to a bracket 262*a* secured to the sidewall of cylinder 264 by pin P1. Cylinder 264 has a pair of input ports 264*b*, 264*c* for selectively driving output shaft 264*a* to project same outwardly from cylinder 264 or to draw such shaft into cylinder 264 so as to be selectively movable in either direction as shown by double-headed arrow Z.

Linkage arm 269 is provided with an integral projection bracket 269*a* at its end having an opening and bearing 269*b* therein for rotationally supporting a shaft 271. A ball or oval-shaped tool or treatment member 274 is mounted on the lower end of shaft 271.

Motor 270 is operated to selectively power revolve oval-shaped member 274 about the central axis of shaft 256. The radial distance between the central axis of shaft 271 and shaft 256 is variably controlled by the controlled operation of cylinder 264. For example, by operating cylinder 264 to extend its piston and output shaft 264*a* from the cylinder housing, linkage arm 269 is caused to rotate counterclockwise about pivot pin P3, thus moving shaft 271 closer to the longitudinal axis of shaft 256 as shown by the dashed notation of arm 269'. FIG. 10*d* shows a simplified schematic top plan view of this arrangement wherein the dashed circle 271' represents the circular path of travel of shaft 271 as it is power rotated about shaft 256 by motor 270 and when the shaft 264*c* of cylinder 264 is further extended from the cylinder 264.

By retracting piston shaft 264*a* in reverse into the cylinder housing, linkage arm 269 rotates clockwise from the dashed line position 269' towards the location shown, causing shaft 271 to be revolved by motor 270 about a circular path represented by circle 271" shown in FIG. 10*d*.

A spray head 276 may be mounted at the lower end of shaft 256. In one embodiment, shaft 256 is provided with a passageway 256*i* through which extends a conduit 278 for coupling a source of fluent material to spray head 276, which fluent material may be conveyed under pressure to provide a fluent spray 280 of coating material for reinforcing the surface of a pothole.

A sensor means 282 secured to the cylinder 264 by a bracket, as shown by dashed lines 282*a*, 282*b*, senses the back pressure applied against the cylinder 264 and thereby senses the force exerted by the tool head or treatment member 274 against the surface of such pothole wall engaging member.

Sensor 282 (or an auxiliary sensing means) may also be coupled to cylinder 285 shown in FIG. 10*j* and operable to monitor the pressure or force applied by the tool head or treatment member 274 to paving material defining pothole surfaces.

Member 274 is preferably ball or oval-shaped in vertical cross-section and is circular-shaped in horizontal cross-section. Member 274 may have a smooth outer surface as shown in FIG. 10*e* or may have an irregular or a polygonal cross-section as shown in FIG. 10*f*. It may also have a corrugated horizontal cross-section as shown in FIG. 10*g*, to aid in shaping and/or compacting. The shape of the treatment member 274 assures engagement between the surfaces of member 274 and the pothole even though the support shaft may be oriented at an angle to the vertical, due to the swinging movement of linkage arm 269.

Operation of the treatment system 250 is as follows:

Once the location, size, depth, volume, etc. of a pothole are determined, assembly 250 is selectively moved horizontally and vertically (preferably under computer control—see FIG. 8) as shown by the arrows X and Y, the horizontal movement being effected by motor 257 whose output gear 259 engages a gear rack 253*a* arranged along the outer surface of track 253 which is secured to the vehicle. The outer ends 252*b* of the arms which form the support bracket 252 slidably receive track 253. The outer ends of the arms that form the V-shaped bracket 254 slidably receive track 255. Operation of bi-directional gear-motor 257 causes its output shaft mounted gear 259 to rotate in a direction to move the assembly either toward the left or toward the right as shown by double-headed arrow X in FIG. 10*b*.

Thereafter, power cylinder 264 is operated responsive to the size of the pothole to position piston rod 264*a* relative to cylinder 264 thereby predetermining the distance of the centerline of shaft 272 relative to the centerline of shaft 256.

Either motor 258 or cylinder 285 is then operated to lower member 274 into the pothole whereafter motor 270 is operated to cause the assembly including collars 268 and 262 and the linkage assembly supporting treatment member 274, as well as member 274, to revolve about shaft 256 along a circular path determined by the extension distance of piston rod 264*a* from the housing of cylinder 264.

In one embodiment, treatment member 274 is freewheelingly mounted upon shaft 271 and rotates about the longitudinal axis of shaft 271 as it is being revolved about shaft 256. The force applied by treatment member 274 upon the surface of the pothole is controlled by the force applied thereto by cylinder assembly 264. A downward force may be applied by power operation of cylinder 285. Repetitive forces can be applied to a pothole by alternating the introduction of hydraulic fluid into input ports 285*b*, 285*c* of hydraulic cylinder 285.

The ball or oval-shaped treatment member 274 thus presses against the sides and/or bottom of the pothole causing the material of the walls of the pothole to compress and densify.

Depending on the shape of the perimeter of the treatment member 274, the treatment member may also act to abrade or wear away material from the sidewall, for example, when employing tool head shapes of the types shown, for example, in FIGS. 10*f* and 10*g*.

As an alternative to providing a mechanism in which treatment member 274 is free to rotate about shaft 271, a motor 273 may be mounted on the linkage assembly, such as linkage arm 269. Motor 273 is provided having an output gear 273*a* which meshes with a gear 271*a* integral with the upper end of shaft 272 to rotate treatment member 274 in addition to and independently of the revolving movement of tool head 274. This arrangement may be used in conjunction with the revolving of member 274 about shaft 256 or, in the alternative, may be employed to rotate member 274 for applications where the pothole is too small to enable member 274 to be revolved within the pothole. If desired, a clutch assembly may be arranged in motor 273 to permit shaft 271 to rotate freely as it revolves about shaft 256.

To assure that treatment member or tool head 274 applies suitable pressure against the inside surfaces of the pothole, motor 270 may be operated to cause tool head 274 to operate in a reciprocating manner through a very small angle or arc as it also is power rotated by its drive motor 273.

The treatment member or tool head 274 may be revolved in the opposite direction each time a full revolution is completed to avoid wrapping of the conductors coupling power to motor 271 about shaft 256.

In still another alternative arrangement, member 274, which is preferably formed of a suitable metal such as a hardened steel or a suitable composite high strength plastic or ceramic material, may be comprised of substantially crescent-shaped sections (much like the sections of an orange) 274*a* shown in FIG. 10*h* and arranged about a center core 274*b* having a central opening and bearing for receiving shaft 271. The crescent-shaped sections 274*a* are secured against core 274*b* by a pair of garter springs 279, 281 arranged within grooves provided about the periphery of each crescent-shaped section 274*a*, as shown in FIG. 10*i*. Core 274*b* is provided with an inflatable central section 274*d* which is inflated by means of pressured air or gas introduced into core 274*b* by inlet 274*c* coupled to a pressurized source by a suitable conduit. By inflating the inflatable portion, the crescent-shaped sections 274*a* are moved away from the shaft 271 to effectively enlarge the diameter of the treatment member 274.

This arrangement may be utilized when member 274 is revolved about shaft 256 or when member 274 experiences only rotation about the axis of shaft 271.

After the abrading, compressing and densifying operation is complete, the surface of the pothole may be sprayed with a suitable fluent material flowed from spray head 276, which material may comprise a surface hardening or hard coating material such as a clay, wax or polymer which serves as a support binder or adhesive for the pothole filling material which is introduced into the pothole by means of any of the apparatus and techniques described hereinabove such as, for example, the nozzle 70 shown in FIG. 5.

Figure 11:
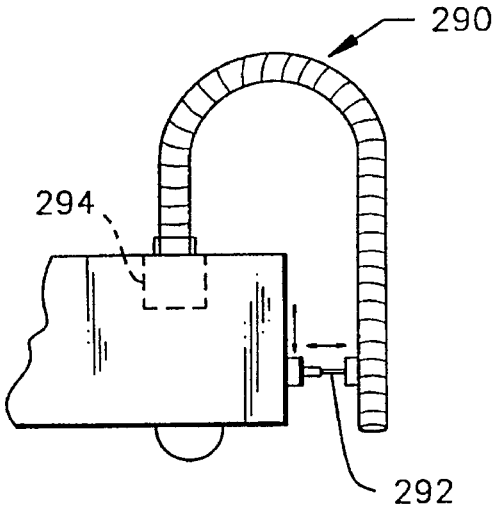
FIG. 11 shows a view of a vacuum apparatus usable with the treatment member of FIGS. 10*a*–10*c*.

In the event that the abrading, densifying or compressing operations cause particulate to be abraded from or break loose from the surface of a pothole, assembly 250 is lifted and a vacuum suction unit having a flexible duct 290, shown in FIG. 11, carried by an automatic manipulator or supported by the vehicle or supported near its end by arm 269, may be either manually or automatically lowered into the pothole under control of the master computer 61 (FIG. 6) or 201 (FIG. 8) to remove debris once the treatment member 274 is lifted out of the pothole.

If desired, the treatment assembly 250 may again be lowered to enable the spray member 280 to spray the fluent material for coating the surface of the pothole. A conduit 290, which is coupled at one end to a vacuum source 294 may be manually lowered into the pothole. Alternatively, the vacuum duct 290 may be comprised of an auxiliary member independent of the vehicle.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. In combination, a wheeled vehicle and apparatus for treating potholes mounted on said vehicle and comprising:

a movably mounted support providing a central axis;

a treatment member rotatably mounted about a rotation axis at a lower end of said support;

means for moving said movable support to direct said treatment member into a pothole to be repaired;

means for selectively rotating said treatment member about said rotation axis; and means for selectively revolving said treatment member a spaced distance about the central axis to engage at least sidewalls of a pothole, wherein said treatment member may rotate about said rotation axis simultaneously with being revolved about said central axis, wherein said treatment member may rotate about said rotation axis independently of being revolved about said central axis, and wherein said treatment member may revolve about said central axis without being rotated about said rotation axis.

2. Apparatus for treating potholes, comprising:

a movably mounted support providing a central axis;

a treatment member mounted at a lower end of said support, said treatment member being rotatable about a rotation axis spaced from said central axis;

means for moving said support to direct said treatment member into a pothole to be repaired;

means for selectively rotating said treatment member about said rotation axis; and means for revolving said treatment member about said central axis to engage at least sidewalls of a pothole, wherein said treatment member may rotate about said rotation axis simultaneously with being revolved about said central axis, wherein said treatment member may rotate about said rotation axis independently of being revolved about said central axis, and wherein said treatment member may revolve about said central axis without being rotated about said rotation axis.

3. The apparatus of claim 2 wherein said treatment member is a substantially ball or oval-shaped member.

4. The apparatus of claim 2 wherein said treatment member is a substantially oval-shaped member having a substantially oval-shaped cross-section taken through a first plane parallel to said rotation axis and having a substantially circular cross-section taken through a second plane perpendicular to said first plane.

5. The apparatus of claim 2 wherein said treatment member has a plurality of flat surfaces operable to selectively compress and abrade the surface of a pothole.

6. The apparatus of claim 2 wherein said treatment member has a substantially corrugated outer surface configuration to facilitate the compression and abrading of the pothole surface.

7. The apparatus of claim 2 wherein said moveable support comprises an elongated shaft;

bracket means for slidably supporting said shaft; and motor means for moving said shaft toward and away from a pothole to be repaired.

8. The apparatus of claim 2 wherein said means for moving said support comprises means for selectively moving said support in mutually perpendicular directions to place said treatment member over said pothole and into said pothole.

9. The apparatus of claim 2 further comprising spray means mounted upon said support for spraying a fluid material into a pothole.

10. The apparatus of claim 9 wherein conduit means is provided along said support for delivering fluid material to said spray means.

11. The apparatus of claim 2 further comprising means for withdrawing particulate and debris from said pothole after treatment by said treatment member.

12. The apparatus of claim 2 further comprising means for sensing the location and size of a pothole and means for moving the treatment member responsive thereto.

13. The apparatus of claim 2 further including a wheeled vehicle supporting said support.

14. The apparatus of claim 2 further including a vehicle supporting said support.

15. The apparatus of claim 14 wherein said vehicle is self propelled.

16. The apparatus of claim 14 wherein said vehicle a trailer pulled by a self propelled vehicle.

17. The apparatus of claim 2 wherein said support comprises an automatic computer controlled manipulator.

18. The apparatus of claim 2 wherein said support comprises an articulated arm assembly.

19. The apparatus of claim 2 including a computer controlled sensing system operable to analyze sensing signals derived in sensing potholes in a road.

20. The combination of claim 2 further comprising means for moving the treatment member radially outward from said central axis for engagement with a sidewall in the pothole.

21. Apparatus for treating potholes, comprising:

a movably mounted support;

a treatment member being rotatably mounted at a lower end of said support;

means for moving said support to direct said treatment member into a pothole to be repaired;

means for either rotating said treatment member about a central axis or revolving said treatment member about a central axis, said support comprising an elongated shaft;

bracket means for slidably supporting said shaft; motor means for moving said shaft toward and away from a pothole to be repaired, means for positioning said treatment member an adjustable distance from a longitudinal axis of said shaft; and means for revolving said treatment member about said longitudinal axis of said shaft.

22. The apparatus of claim 21 wherein said means for positioning said treatment member an adjustable distance from said shaft comprises linkage means including at least one linkage assembly having a cylinder assembly and means for extending a piston rod from said cylinder assembly by a given distance.

23. The apparatus of claim 21 wherein said means for positioning a treatment member an adjustable distance from said longitudinal axis of said shaft further comprises:

first collar means rotatable about said shaft;

a first linkage arm having one end pivotally coupled to said first collar means;

a cylinder assembly having a first end pivotally coupled to a second end of said first linkage arm;

second collar means rotatable about said shaft; and said cylinder assembly having a piston rod, a free end of said piston rod being pivotally coupled to said second collar member;

said piston rod being selectively extendable from and retractable into said cylinder assembly to adjust the spacing distance of said treatment member from said shaft, said treatment member being rotatably mounted upon said first linkage arm.

24. The apparatus of claim 23 further comprising means for revolving said first linkage arm and said treatment member about the longitudinal axis of said shaft.

25. The apparatus of claim 21 further comprising means for rotating said treatment member about its axis of rotation.

26. Apparatus for treating potholes, comprising:

a movably mounted support;

a treatment member being rotatably mounted at a lower end of said support;

means for moving said support to direct said treatment member into a pothole to be repaired;

means for either rotating said treatment member about a central axis or revolving said treatment member about a central axis; and sensing means for sensing a pressure applied by said treatment member against a surface of said pothole.

27. The apparatus of claim 26, further comprising a cylinder assembly, wherein said sensing means senses back pressure applied to said cylinder assembly through said treatment member.

28. Apparatus for treating potholes, comprising:

a movably mounted support;

a treatment member being rotatably mounted at a lower and of said support;

means for moving said support to direct said treatment member into a pothole to be repaired;

means for either rotating said treatment member about a central axis or revolving said treatment member about a central axis; and spray means mounted upon said support for spraying a fluid material into a pothole, said fluid material being taken from a group of materials consisting of a sealing agent, a hardening agent and an adhesive material.

29. Apparatus for treating potholes, comprising:

a movably mounted support;

a treatment member being rotatably mounted at a lower end of said support;

mean for moving said support to direct said treatment member into a pothole to be repaired; and means for either rotating said treatment member about a central axis or revolving said treatment member about a central axis; and said support comprising an articulated arm assembly defining an automatic manipulator for said treatment member and an automatic computer for controlling the operation of said manipulator.

* * * * *